United States Patent [19]

Iwakiri

[11] 4,268,735

[45] May 19, 1981

[54] PUSHBUTTON PILOT SWITCH

[75] Inventor: Norio Iwakiri, Kyoto, Japan

[73] Assignee: Omron Tateisi Electronics Co., Kyoto, Japan

[21] Appl. No.: 69,136

[22] Filed: Aug. 23, 1979

[30] Foreign Application Priority Data

Aug. 30, 1978 [JP] Japan ..... 53-106751

[51] Int. Cl.[3] ..... H01H 9/16

[52] U.S. Cl. ..... 200/314; 200/67 B

[58] Field of Search ..... 200/153 J, 159 R, 159 A, 200/159 B, 314, 340, 676 B, 310

[56] References Cited

U.S. PATENT DOCUMENTS

| | | | |
|---|---|---|---|
| Re. 26,936 | 8/1970 | Waldorf | 200/340 |
| 2,957,072 | 10/1960 | Rigel | 200/314 |
| 3,521,013 | 7/1970 | Baumanis | 200/314 |
| 3,594,528 | 7/1971 | Viau | 200/340 |
| 3,602,678 | 8/1971 | Laete | 200/314 |
| 3,766,350 | 10/1973 | Van Dyk et al. | 200/159 R |

FOREIGN PATENT DOCUMENTS

| | | | |
|---|---|---|---|
| 2379896 | 9/1978 | France | 200/314 |

*Primary Examiner*—John W. Shepperd

*Attorney, Agent, or Firm*—Sughrue, Rothwell, Mion, Zinn and Macpeak

[57] ABSTRACT

A pushbutton pilot switch is disclosed having an elongated housing, a switch arrangement accommodated in the housing and an actuating unit coaxially housed in the elongated housing. The actuating unit includes a base member which is detachably engaged in the housing, an illuminating element mounted on the base member, and a cap member detachably and slidingly mounted on the base member for axial movement in the elongated housing between depressed and projected positions.

8 Claims, 6 Drawing Figures

PUSHBUTTON PILOT SWITCH

The present invention relates to a pushbutton switch and, more particularly, to a pushbutton switch having an illuminator.

It is known in the art to employ an illuminating element in a pushbutton switch for effecting the illumination of the element when the pushbutton switch is actuated or when it is necessary to be actuated. This type of pushbutton switch is hereinafter referred to as a pushbutton pilot switch.

One conventional pushbutton pilot switch disclosed in U.S. Pat. No. 4,096,368 to Grebner employs a candescent lamp for the illuminating element. This type of pushbutton pilot switch, however, is considerably large in size and has a considerably short lifetime because of a relatively short life time of the candescent lamp. Furthermore, the heat radiated from the candescent lamp undesirably heats up the switch, particularly the switch button.

From this point of view, an improved pushbutton pilot switch such as disclosed in Japanese Patent Laid-Open Publication No. 107378/1977 published on Aug. 16, 1977 has been proposed which employs a light emitting diode as the illuminating element. According to this publication, the pushbutton pilot switch includes a housing and an actuator which is telescopically received in one end of the housing for longitudinal movement therein. At least one coil spring is biased between the housing and the actuator for urging the actuator towards a projected position. The light emitting diode is rigidly mounted in the actuator so that the light emitting diode moves together with the actuator.

In the conventional pushbutton pilot switches described above, no consideration has been taken to a method or arrangement for the replacement of the illuminating element or a color filter which may be attached or integrally included in the actuator.

Furthermore, when the light emitting diode is employed for the illuminating element, a resistor for controlling the actuating current of the light emitting diode is externally connected to the pushbutton pilot switch.

It is a primary object of the present invention to provide an improved pushbutton pilot switch wherein the illuminating element and/or color filter or others which are assembled in the actuator can readily be replaced.

It is also a primary object of the present invention to provide an improved pushbutton pilot switch which is internally provided with resistor for controlling the actuating current of the illuminating element.

It is another object of the present invention to provide an improved pushbutton pilot switch which is simple in construction and can readily be manufactured at low cost.

In accomplishing these and other objects, a pushbutton pilot switch, according to the present invention, comprises an elongated housing having an opening at one end thereof and including an engaging member formed inside the housing at a substantially intermediate portion thereof, the elongated housing having a plurality of terminal projections each having one end situated within housing and the other end projecting outwards from the housing for external electric connection and a switch arrangement accommodated within the elongated housing and electrically connected to at least two of the terminal projections. A base is housed inside the elongated housing and includes an engageable member adapted to be engaged with the engaging member for preventing the base from being slidably moved outside the housing. The engagement between the engaging member and engageable member can be disengaged when the base is applied with an external force acting in a direction outwardly of the housing through the opening.

A pushbutton pilot switch further comprises an illuminating member mounted on the base and an actuator coaxially housed in the elongated housing for axial movement between depressed and projected positions. The actuator when held in any one of the depressed and projected positions has one end extending outwards from the housing through the opening and the other end housed within the housing. The other end of the actuator is detachably connected to the base and includes an actuating member which actuates the switch arrangement when the actuator is moved to the depressed position. A plate member is secured to the base, and has an electrically resistive film laminated thereon and connected to the illuminating member for controlling the actuating current for lighting the illuminating member.

The foregoing and other objects, features and advantages of the invention will be apparent from the following description of the invention with reference to the accompanying drawings in which.

Before the description of the present invention proceeds, it is to be noted that like parts are designated by like reference numerals throughout the accompanying drawings.

Figure 1:
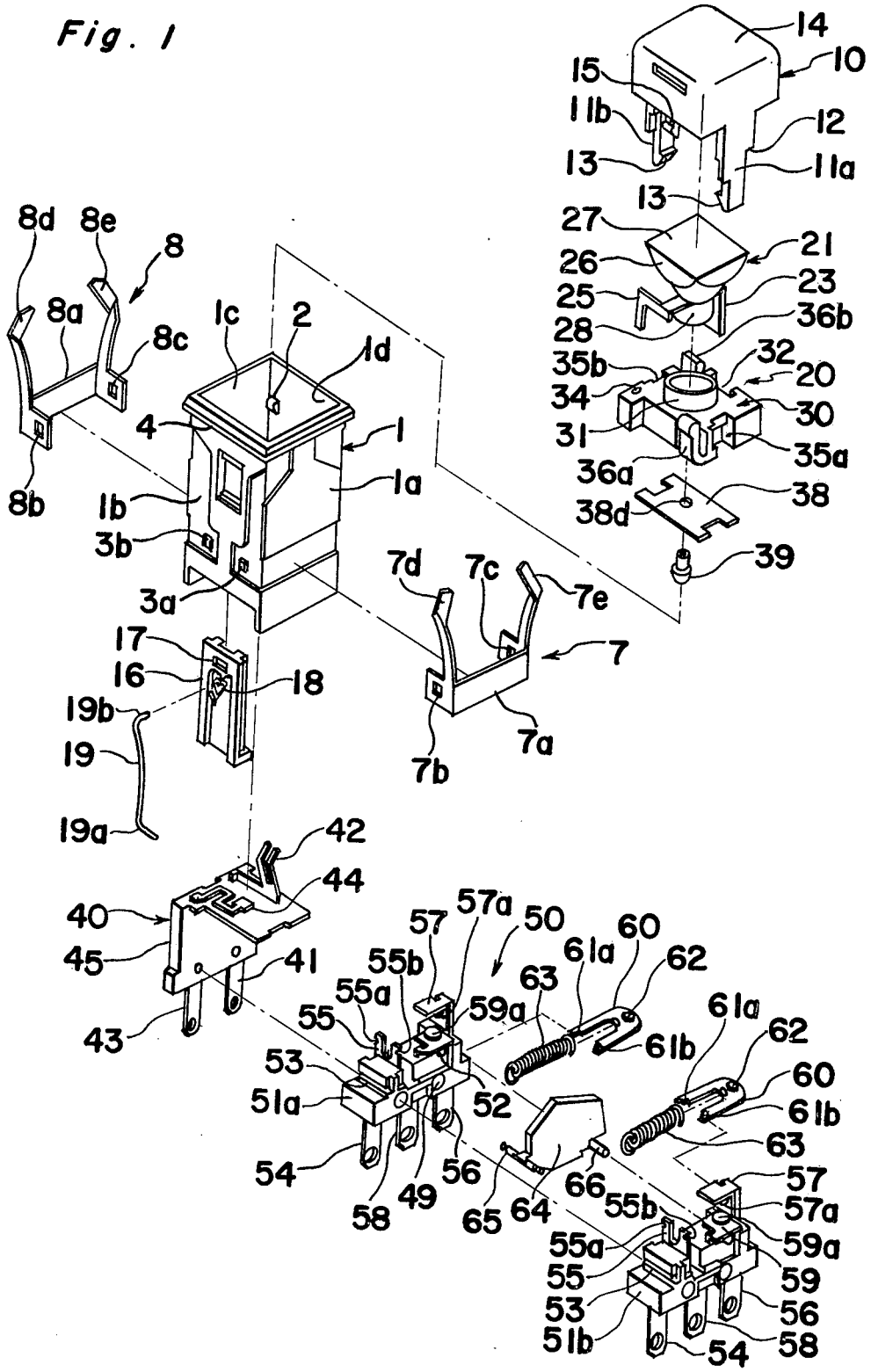
FIG. 1 is an exploded view of a pushbutton pilot switch according to the present invention.

Referring to FIG. 1, a pushbutton pilot switch according to the present invention comprises an elongated housing 1 of substantially rectangular cross-section constituted by four side walls 1*a*, 1*b*, 1*c* and 1*d* with its opposite ends opened. The opened end of the housing 1 provided with a flange 4 therearound is referred to as an upper end while the other opened end remote from the upper end is referred to as a lower end.

A holder member 7 having openings 7*b* and 7*c* formed therein is applied to the side walls of the housing 1 with said openings 7*b* and 7*c* receiving respective projections 3*a* formed on the side walls 1*b* and 1*d*. The holder member 7 also has two elastic arms 7*d* and 7*e* projecting outwards from a body 7*a* and curved in a diverging relation to each other.

Figure 2:
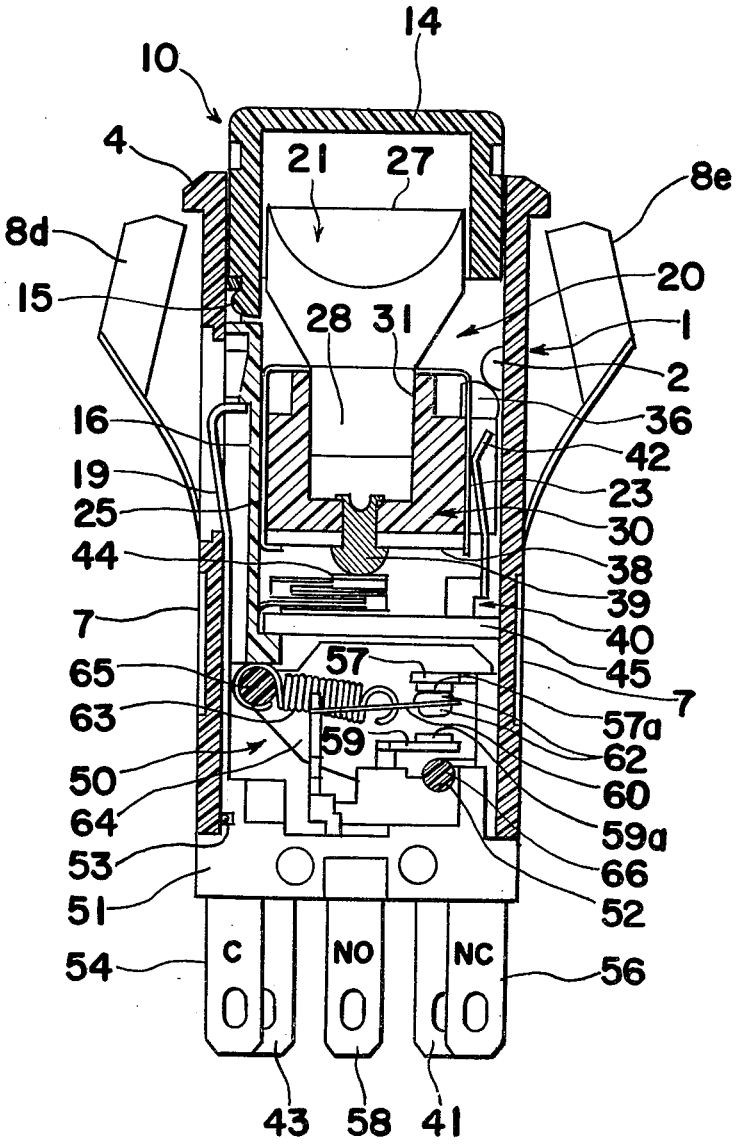
FIG. 2 is a side sectional view of the pushbutton pilot switch.
Figure 3:
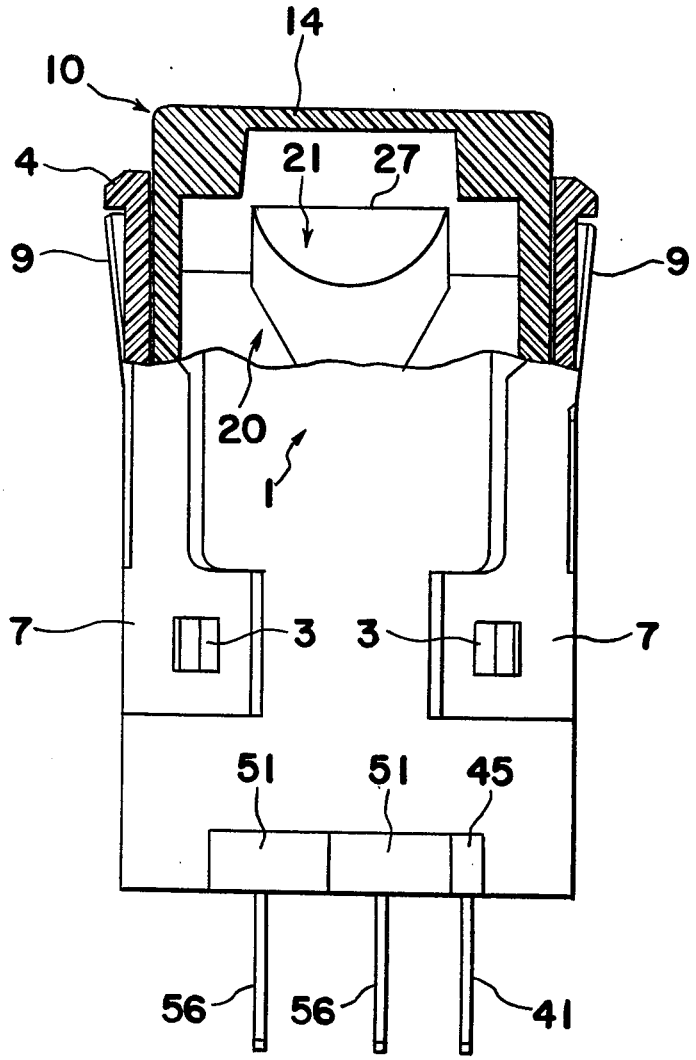
FIG. 3 is a side elevational view of the pushbutton pilot switch with a portion broken away to show an inside structure.

In a similar manner, a holder member 8 having openings 8*b* and 8*c* formed therein is applied to the side walls of the housing 1 with said openings 8*b* and 8*c* receiving projections 3*b* formed on the side walls 1*b* and 1*d*. The holder member 8 also has two elastic arms 8*d* and 8*e* projecting outwards from a body 8*a* and curved in a diverging relation to each other as best shown in FIG. 2. The elastic arms 7*d*, 7*e*, 8*d* and 8*e* are provided for tightly holding the housing 1 in an opening (not shown) for installing the pushbutton switch.

Accommodated in the housing 1 is an actuator unit comprising a cap member 10, an illuminating member 21 and a stationary base member 30, and a switching unit comprising terminal block 40 and a switching block 50. First the switching unit is described with reference to FIGS. 1 and 2.

The terminal block 40 of the switching unit includes a generally L-shaped block 45 made of synthetic resin, a bifurcated terminal member 42 extending upwardly from the block 45, a spring terminal member 44 extending upwardly from the block 45, and a pair of pin projections 41 and 43 extending downwardly from the block 45. The pin projection 41 is electrically connected to the bifurcated terminal member 42 while the pin projection 43 is electrically connected to the spring terminal member 44. In practice, the pin projection 41 and the bifurcated terminal member 42 are of one-piece construction while the pin projection 43 and the spring terminal member 44 are of one-piece construction.

The switching block 50 of the switching unit includes two supporting blocks 51*a* and 51*b* each including three pin projections 54, 58 and 56. The pin projection 54 is electrically connected to a U-shaped plate member 55 having recesses 55*a* and 55*b* at upper end portion thereof. The pin projections 58 and 56 are electrically connected to metallic supporting plates 59 and 57, respectively. A disk shaped contact member 59*a* is rigidly mounted on the supporting plate 59 and a similar disc shaped contact member 57*a* is rigidly mounted on the supporting plate 57 in face-to-face relation with the former contact member 59*a*. The two supporting blocks 51*a* and 51*b* are connected with each other when recesses 49 formed in the supporting block 51*a* receive corresponding projections (not visible in FIG. 2) formed in the supporting block 51*b*.

When the supporting blocks 51*a* and 51*b* are connected together, an axle 66 integrally or fixedly formed with a plate 64 is rotatably inserted into respective openings 52 formed in the supporting blocks 51*a* and 51*b* so that the plate 64 can rotate about the axle 66. An edge of the plate 64 which is remote from the axle 66 is rigidly connected with a bar member 65 which extends in parallel to the projection 66.

There is employed a pair of substantially U-shaped movable contact members, generally identified by 60, of identical construction. Because of the identical construction, the details of only one of the U-shaped members 60 will now be described.

A U-shaped member 60 having narrowed tips 61*a* and 61*b* is pivotally held by the U-shaped plate member 55 with the narrowed tips 61*a* and 61*b* engaged to the recesses 55*a* and 55*b*, respectively. The U-shaped member 60 has a contact 62 at the center and on both sides thereof. When the U-shaped member 60 is pivotally connected to the U-shaped plate member 55 in the manner described above, the contacts 62 is positioned in a space between the similar disk shaped contact members 57*a* and 59*a*. A coil spring 63 extends between the center of the U-shaped member 60 and the bar member 65 for holding the contact 62 in contact with either one of the contact member 57*a* or 59*a*.

Referring particularly to FIG. 2, the contact 62 is in contact with the contact 57*a* because the coil spring 63 held in a position as shown urges the U-shaped member 60 to rotate in a counterclockwise direction. Accordingly, the pin projection 54 is electrically connected to the pin projection 56. In the position shown in FIG. 2, the plate 64 is urged to rotate in a clockwise direction about the axle 66 by the action of the coil springs 63, however, the rotation thereof is restricted by the engagement of the bar member 65 with a sliding plate 16 which slides relatively to the actuator unit. When the sliding plate 16 is moved downwardly in a manner described later, the bar member 65 is depressed with the plate 64 rotating in the counterclockwise direction about the axle 66. When the bar member 65 is brought to a position lower than the pivot point where the U-shaped member 60 is pivotally connected to the U-shaped plate member 55, the U-shaped member 60 is urged to rotate in the clockwise direction about the pivot point so that the contact 62 which has been in contact with the contact member 57*a* can be brought in position to contact the lower contact member 59*a*. Accordingly, the pin projection 54 is electrically connected to the pin projection 58. In this position, the coil spring 63 still urges the plate 64 to rotate in the clockwise direction.

Next, the manner in which the switching unit together with the sliding plate 16 is inserted into the housing 1 from the lower opened end is described.

First, the blocks 51*a* and 51*b* are joined to each other in the manner described above and, then, the L-shaped block 45 is joined to the block 51*a* in a similar manner. When the blocks 51*a* and 51*b* are joined, a T-shaped groove 53 is formed on the left-hand side of the combined blocks 51*a* and 51*b* for receiving an L-shaped end portion 19*a* of a pin 19. The other end portion 19*b* of the pin 19 is also bent to assume a substantially L-shape. When the blocks 51*a*, 51*b* and 45 are joined together, the lower end of the sliding plate 16 is placed over the bar member 65 while the lower end 19*a* of the pin 19 is received in the groove 53 with the upper end of the pin 19 held in contact with the sliding plate 16. With the pin 19 so held in position, the tip of the L-shaped end 19*b* is guided along a heart-shaped groove 18 formed in the sliding plate 16. Since the inside surface of the side wall 1*b* is formed with a pair of rails (not shown), the sliding plate 16 is supported for the movement only in a direction parallel to the axial direction of the housing 1. The joined blocks 51*a*, 51*b* and 45 are snap-fittingly inserted into the housing 1.

Figure 4:
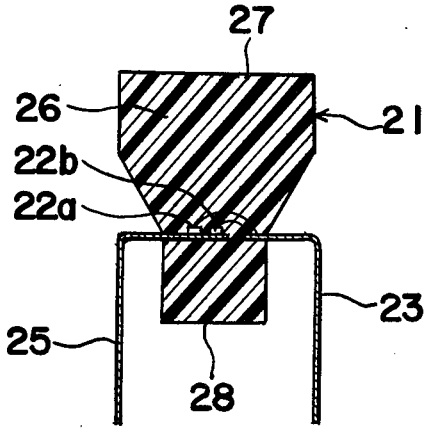
FIG. 4 is a side sectional view of a illuminating member employed in the pushbutton pilot switch.

The actuator unit is now described. The illuminating member 21 includes, as best shown in FIG. 4, light emitting diodes 22*a* and 22*b* and plate terminals 23 and 25 which are all held in a position as shown and embedded in a block of transparent synthetic resin formed by an injection molding. The light emitted from the diodes 22*a* and 22*b* are refracted in the block of synthetic resin to radiate parallel and uniform light beam from an upper flat surface 27 in the axial direction. A lower portion of the illuminating member 21 is formed with a cylindrical projection 28 which is also made of the synthetic resin.

The stationary base member 30 made of synthetic resin has an opening 31 formed at the center thereof for receiving the cylindrical projection 28 of the illuminating member 21. The terminal plate 23 extending from the illuminating member 21 is guided along a groove 32 formed on a side face of the base member 30 while the terminal plate 25 is inserted into a hole 34 formed in the base member 30 in a direction of the thickness thereof. The tip of the terminal plate 25 so inserted into the hole 34 protrudes outwards from and terminates below the bottom surface of the base member 30. The base member 30 is further formed with grooves 35*a* and 35*b* for slidingly receiving leg members 11*a* and 11*b* of the cap member 10 and a pair of leaf springs 36*a* and 36*b* provided at the opposed corners of the base member 30. The tip of each leaf spring 36*a* or 36*b* which is remote from the end connected integrally with the base member 30 is formed with a thick gauged portion for the engagement with a rounded projection 2 formed on the inside surface of the opposed walls 1*b* and 1*d* of the housing 1.

The two leg members 11*a* and 11*b* of the cap member 10 made of plastics or synthetic resin extend downwardly from the opposed sides of the cap member 10 and are adapted to be slidingly inserted into the grooves 35*a* and 35*b*, respectively, of the base member 30. The free end portion of each of the leg members 11*a* and 11*b* is formed with a hook 13 engageable in a recess formed in each of the groove 35*a* and 35*b*. Each leg member 11*a* or 11*b* also has an edge 12 for the engagement with the upper surface of the base member 30. Such engagement between the edge 12 and the upper surface of the base member 30 prevents the cap member 10 from being further depressed. The cap member 10 further includes a hook 15 which snap-fittingly engages in a recess 17 formed in the sliding plate 16 when inserted into the housing 1. The top plate 14 of the cap member 10 is provided with, or otherwise formed into, a transparent or color filter for allowing the light beam radiated from the illuminating element 21 to pass therethrough.

Figure 6:
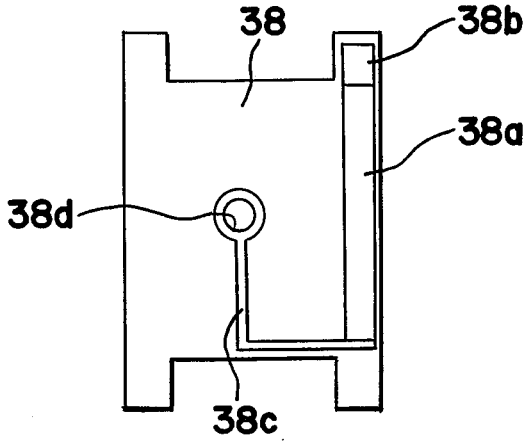
FIG. 6 is a bottom plan view of a plate showing one pattern in which a resistive film is printed.

Provided on the bottom surface of the base member 30 is an H-shaped plate 38 made of synthetic resin. The bottom surface of the H-shaped plate 38 is laminated with a strip of resistor film 38*a* as best shown in FIG. 6. One end of the resistor film 38*a* is connected to a metallic terminal film 38*b* which is also laminated on the bottom surface of the H-shaped plate 38. The other end of the resistor film 38*a* is connected to a laminated metallic film conductor 38*c* which extends to the periphery of a opening 38*d* formed in the center of the plate 38. The resistor film 38*a* and metallic films 38*b* and 38*c* can be formed by a method of printing, etching or any other known method. The H-shaped plate 38 is secured in position to the bottom face of the base member 30 by a metallic rivet 39 inserted into the opening 38*d* and further into a similar opening formed in the base member 30. Accordingly, the metallic rivet 39 is electrically connected to the metallic film conductor 38*c* and, hence, to the other end of the resistor film 38*a*. The metallic terminal film 38*b* is electrically connected to the tip of the terminal plate 25 projecting from the hole 34 and terminating adjacent the terminal film 38*b* by a suitable connecting means such as soldering. Accordingly, the terminal plate 25 is in electric connection with the metallic terminal film 38*b* and, hence, with one end of the resistor film 38*a*. The above described resistor film 38*a* is provided for controlling the current flowing through the light emitting diodes 22*a* and 22*b*.

When the actuator unit is to be assembled, the illuminating member 21 is rigidly mounted on the base member 30 while the H-shaped plate 38 is tightly secured to the bottom surface of the base member 30. On the other hand, the cap member 10 is slidably mounted on the base member 30. During the mounting of the cap member 10 on the base member 30, the leg members 11*a* and 11*b* are temporarily and forcibly enlarged for allowing the hook 13 to reach the recessed portion in each of the grooves 35*a* and 35*b*. Therefore, the upward movement of the cap member 10 relative to the base member 30 is limited by the engagement between the hook 13 and the upper end of the recessed portion in the grooves 35*a* and 35*b* while the downward movement of the cap member 10 relative to the base member 30 is limited by the engagement between the edge 12 and the upper surface of the base member 30. The cap member 10 can easily be separated from the base member 30 when the leg members 11*a* and 11*b* are again forcibly enlarged to disengage the hook 13 from the recessed portion in the grooves 35*a* and 35*b*.

For accommodating the actuating unit in the housing 1, the assembled actuating unit is forcibly inserted into the housing 1 from the upper opening of the housing 1 until the thick gauged portion of the leaf spring 36*a* and 36*b* move past the rounded projection 2 formed in the housing 1. A further insertion of the actuating unit is prevented by the engagement between the lower surface of the base member 30 and a projection (not shown) formed inside the housing 1. During the insertion of the actuating unit in the housing 1, the hook 15 formed on the cap member 10 is engaged in the opening 17 formed in the sliding plate 16. Accordingly, the cap member 10 receives an upward biasing force exerted by the springs 63 and transmitted thereto through the sliding plate 16 by way of the bar member 65. When the actuating unit is properly accommodated in the housing 1, the head portion of the rivet 39 is held in contact with a spring terminal member 44 while the terminal plate 23 is held in contact with the bifurcated terminal member 42. Therefore, the light emitting diodes 22*a* and 22*b* are electrically connected through the resistor film 38*a* to the pin projections 41 and 43.

When it is necessary to exchange the cap member 10 or illuminating member 21, the actuating unit can be removed out of the housing 1. This can readily be accomplished by pulling the cap member 10 outwards from the housing 1, since the engagement between the actuating unit and the housing 1 is effected between the thick gauged portion of the leaf springs 36*a* and 36*b* and rounded projection 2 and also between the hook 15 of the cap member 10 and the opening 17 formed in the sliding plate 16. More particularly, when the cap member 10 is pulled up, the leg members 11*a* and 11*b* of the cap member 10 accordingly pulls up the base member 30. Since the thick gauged portion of the leaf springs 36*a* and 36*b* are rounded while the projection 2 in the housing 1 is also rounded, the pull-up of the base member 30 results in bending movement of the leaf spring with the thick gauged portion slidingly moving over the projection. Similarly, since the hook 15 is rounded, it can simply be disengaged from the opening 17.

After the actuating unit has been removed, the cap member 10 can be detached from the base member 30 by forcibly opening the legs 11*a* and 11*b* in a direction away from each other. The illuminating member 21 can be detached from the base member 30 by simply removing the bonding agent or soldering used to connect between the terminal plate 25 and the terminal film 38*b* and then pulling the illuminating member 21 from the base member 30.

The assembly of the actuating unit and mounting the assembled actuating unit in the housing 1 can be effected in a manner reverse to that described above.

Figure 5:
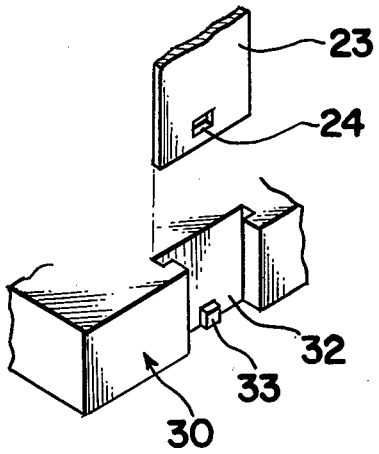
FIG. 5 is a fragmentary perspective view of a base member showing a connection between the base member and a terminal plate extending from the illuminating member.

For securing the connection between the illuminating member 21 and the base member 30, the terminal plate 23 can be formed with an opening 24, as shown in FIG. 5, for receiving a projection 33 provided on the base member 30 when the illuminating member 21 is properly mounted on the base member 30.

The operation of the pushbutton pilot switch will now be described.

The pin projections 41 and 43 are connected to an external control circuit (not shown) for applying a predetermined voltage thereacross so that the illuminating member 21 radiates lights when it is necessary to actuate the push button switch. When the actuating unit is depressed, the sliding plate 16 is depressed accordingly to push down the bar member 65. During the downward movement of the sliding plate 16, the tip of the bent portion **19*b* of the pin 19 slidingly moves in the heart shaped groove 18 from the pointed bottom of the heart shaped groove towards the V-shaped valley of the groove. When the tip of the bent portion 19*b* slides into the V-shaped valley of the heart shaped groove, the sliding plate 16 is held in the depressed position with the plate 64 held in a rotated position for effecting the electrical connection between the contact 62 and the contact 59*a***.

A further depression of the actuating unit into the housing 1 causes a disengagement of the tip of the bent portion **19*b* from the V-shaped valley of the groove. Thus, the tip of the portion 19*b*** moves slidingly in the heart shaped groove towards the pointed bottom thereof.

The illuminating member 21 which has been described as lighted by the external control circuit can be so connected as to be lit by the inserting or projecting movement of the actuating unit.

Since the illuminating member 21 is so designed as to radiate light mostly in one direction parallel to the axial direction of the housing 1, the brightness of the illumination when viewed from the outside and above the filter 14 hardly changes despite the difference in distance between the flat surface 27 of the illuminating member 21 and the filter 14. In other words, the illumination lighted when the filter 14 placed directly over the flat surface 27 has approximately the same brightness as the illumination light with the filter 14 positioned above and away from the flat surface 27.

Furthermore, since the actuating unit can be simple detached from the housing 1 while the detached actuating member can be simply separated into the cap member 10, illuminating member 21 and base member 30, the replacement of any one of the cap member 10, illuminating member 21 or base member 30 can readily be accomplished.

Moreover, since the printed resistor is adapted to be contained in the housing 1, there is no need to employ a resistor element externally connected to the pushbutton pilot switch for controlling the current, and at the same time, the printed resistor does not occupy any substantial space which would otherwise result in the increased size of the pushbutton switch.

Although the present invention has been fully described by way of examples with reference to the accompanying drawings, it is to be noted that various changes and modifications are apparent to those skilled in the art. Therefore, unless such changes and modifications depart from the true scope of the present invention, they should be construed as included therein.

What is claimed is:

1. A pushbutton pilot switch comprising:

an elongated housing having an opening at one end thereof and including an engaging member formed inside the housing at a substantially intermediate portion thereof, said elongated housing having a plurality of terminal projections each having one end situated within housing and the other end projecting outwards from said housing for external electric connection;

a switch arrangement accommodated within said elongated housing, said switch arrangement electrically connected to at least two of the terminal projections;

a base housed inside said elongated housing and including an engageable member adapted to be engaged with said engaging member for preventing the base from being slidably moved outside the housing the engagement between said engaging member and engageable member being disengaged when the base is applied with an external force acting in a direction outwardly of the housing through said opening;

an illuminating member mounted on said base;

an actuator coaxially housed in said elongated housing for axial movement between depressed and projected positions, said actuator when held in any one of the depressed and projected positions having one end extending outwards from said housing through said opening and the other end housed within said housing, said other end of the actuator being detachably connected to the base and including an actuating member which actuates the switch arrangement when the actuator is moved to said depressed position;

said illuminating member comprising a light transmitting block, at least one light emitting diode carried by said block, and optically coupled to said at least one light emitting diode, means for demountably coupling said illuminating member light transmitting block to said base; and a plate member removably secured to the base, said plate member having an electrically resistive film laminated thereon and being electrically connected to said at least one light emitting diode by plate terminals such that said electrically resistive film controls the actuating current for lighting said at least one light emitting diode of said illuminating member;

whereby, when the voltage of said electrical source coupled to the pushbutton switch changes, dependent upon usage, the resistor of said push button pilot switch may be readily exchanged to accommodate the voltage change.

2. A pushbutton pilot switch as claimed in claim 1, wherein said at least one light emitting diode and a pair of terminal plates extending from said at least one diode are held in position and embedded to said block which is formed of an injection-molded transparent synthetic resin, said block having a lens portion formed above said at least one diode with a flat surface for projecting the light radiated from said at least one diode in a direction substantially parallel to the axial direction with uniform brightness, and a projection extending below said at least one diode for removable fit insertion into an opening formed in the base.

3. A pushbutton pilot switch as claimed in claim 1, wherein said illuminating member has first and second terminals, said first terminal connected through the electrically resistive film to one terminal projection while said second terminal is connected to another terminal projection.

4. A pushbutton pilot switch as claimed in claim 3, wherein said plate member is secured to the base by a metallic rivet, said rivet electrically connecting one end of the resistive film with said one terminal projection.

5. A pushbutton pilot switch as claimed in claim 1, wherein said illuminating member has first and second terminals, said first terminal extending along a portion of the perimeter of the base to a portion adjacent one end of the resistive film for connecting the first terminal with the resistive film by means of soldering while said second terminal extends along another portion of the perimeter of the base.

6. A pushbutton pilot switch as claimed in claim 1, further comprising a terminal block, said terminal block comprising a generally L-shaped synthetic resin block and a two part switching block, and wherein said terminal block bears said plurality of terminal projections, said switching block supporting block pairs each comprising a pair of substantially U-shaped movable contact members pivotably connected to U-shaped plate members for respective supporting blocks and carrying contacts at one end movable between overcenter positions and in contact with opposed fixed contacts upon depression and projection of said actuator axially within said housing, a sliding plate slidably mounted within said housing and operatively connecting said actuator with said U-shaped contact members, and a rotatable plate mounted for rotation about an axis at right angles to the direction of movement of said actuator and said sliding plate and being operatively engaged by said sliding plate and functioning to pivot said U-shaped contact members to effect change of state in said switch arrangement by overcenter movement of said U-shaped switch contacts.

7. A pushbutton pilot switch as claimed in claim 6, wherein said sliding plate includes a heart-shaped groove and wherein a pin is mounted along the face of said sliding plate and having one end engaged with said switching block and its other end engaged in said heart-shaped groove, such that during depression of said actuator and movement of said sliding plate, the end of said pin within said heart-shaped groove shifts from one side of said heart-shaped groove to the other with said switching arrangement changing state.

8. A pushbutton pilot switch as claimed in claim 1, wherein said base comprises at least one groove through which one of said terminal plates project connecting said at least one light emitting diode to said electrically resistive film, said base further comprising laterally opposed grooves, said actuator comprising a cap having laterally opposed leg members receivable within said laterally opposed grooves of said base, a stop formed on at least one of said leg members for limiting depression of said actuator cap relative to said base, and said base comprising a pair of leaf springs at opposed corners thereof including thick gauged portions, and wherein said housing includes rounded projections internally and at corresponding opposed corners engageable by said gauged portions to limit upward movement of the base relative to said housing, and wherein said leaf springs permit the thick portion thereof to ride over the rounded projections of said housing during assembly, with said base pressed downwardly and axially through an upper open end of said housing.

* * * * *